US006269491B2

(12) United States Patent
Zankow

(10) Patent No.: US 6,269,491 B2
(45) **Date of Patent: *Aug. 7, 2001**

(54) DECORATIVE ACCESSORY UNIT FOR A SWIMMING POOL

(76) Inventor: Stefan T. Zankow, P.O. Box 7298, Ft. Station, VA (US) 22039

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/427,660

(22) Filed: Oct. 25, 1999

Related U.S. Application Data

(63) Continuation-in-part of application No. 09/376,486, filed on Aug. 18, 1999.

(51) Int. Cl.[7] ..... E04H 4/00
(52) U.S. Cl. ..... 4/496; 239/18

(58) Field of Search ..... 4/496, 507; 239/16–20, 239/21–23; D23/201

(56) References Cited

U.S. PATENT DOCUMENTS

| | | | | |
|---|---|---|---|---|
| 2,870,574 | * | 1/1959 | Sheridan | 239/23 |
| 5,893,179 | * | 4/1999 | Johnson | 4/507 |
| 6,149,070 | * | 11/2000 | Hones | 239/17 |

* cited by examiner

*Primary Examiner*—Charles E. Phillips
(74) *Attorney, Agent, or Firm*—Rossi & Associates

(57) ABSTRACT

A combined receptacle and waterfall unit for a pool or the like includes a receptacle portion and a water dispensing unit positioned in a recessed portion of the rim of the receptacle. The water dispensing unit dispenses water like a waterfall laterally outward from the rim of the receptacle. The receptacle may be shaped to be used as a planter. A lighting device may be positioned on or near the water dispensing unit to illuminate the water being dispensed therefrom.

8 Claims, 6 Drawing Sheets

DECORATIVE ACCESSORY UNIT FOR A SWIMMING POOL

CROSS REFERENCE TO RELATED APPLICATIONS

This application is a continuation-in-part of co-pending U.S. Pat. application Ser. No. 09/376,486 which was filed on Aug. 18, 1999.

FIELD OF THE INVENTION

The present invention relates to a decorative accessory unit for a swimming pool or the like and, more particularly, to a combined planter and waterfall unit which can be installed adjacent to a pool or the like.

BACKGROUND OF THE INVENTION

Current decorative accessory units for swimming pools, for example a waterfall unit, generally require that the waterfall unit be built into the pool or the deck surrounding it. Such installations are expensive and are difficult to service in the event of operational problems. As a result, it is an object of the present invention to provide a decorative accessory unit for a swimming pool or the like which is portable, simple, reliable, easy to service, attractive and serves a dual purpose.

SUMMARY OF THE INVENTION

The present invention provides a decorative accessory unit for a swimming pool or the like which is portable, simple in construction, reliable, easy to service, attractive and serves a dual purpose. In a preferred embodiment, the decorative accessory unit takes the form of a combined planter and waterfall unit that generally includes a lower receptacle portion of any suitable material having a rim, and an upper receptacle of any suitable material having a size and shape complementary to that of the lower receptacle portion so that it can be mounted on and inside of the lower receptacle portion. The upper receptacle portion has a rim that rests on the lower receptacle rim to position the upper receptacle portion within the lower receptacle portion with a predetermined space there between.

A water dispensing unit of any suitable construction is mounted on the lower receptacle portion and is positioned between the upper and lower receptacle portions with the outer edge of its dispensing opening being substantially flush with or in close proximity to the adjacent outer edges of the rims of the upper and lower receptacle portions.

In accordance with another embodiment of the present invention, the receptacle is a solid one piece unit having an upper rim. The rim has a shallow notch in it which is sized to fit the water dispensing unit, so that the water dispensing unit is flush with the rim.

Preferably the dispensing opening of the water dispensing unit is a wide opening or slit of narrow height defined by a sharp lower edge portion to produce a thin, wide and uniform flow or waterfall. In use, the combined planter and waterfall unit is positioned near the edge of a pool or the like so that the waterfall produced thereby flows into the pool.

The water dispensing unit is connected to a water source, such as the pool water, by a water line. In a preferred embodiment, the water line extends therefrom through the space between the upper and lower receptacle portions, and then outwardly through an opening in the lower receptacle portion. The outer end of the water line is connected to a suitable water source such as the pump for circulating pool water or the like.

The upper receptacle portion or the solid receptacle portion can be used as a planter by filling it with soil or the like and planting a desired plant or plants therein. In this maimer, the combined planter and waterfall unit serves a dual function in a very simple construction. The unit may be mounted on a pedestal or the like of any suitable construction.

BRIEF DESCRIPTION OF THE DRAWINGS

The invention will now be described in greater detail with reference to certain preferred embodiments thereof and the accompanying drawings, wherein.

DETAILED DESCRIPTION OF THE PREFERRED EMBODIMENTS OF THE INVENTION

Figure 3:
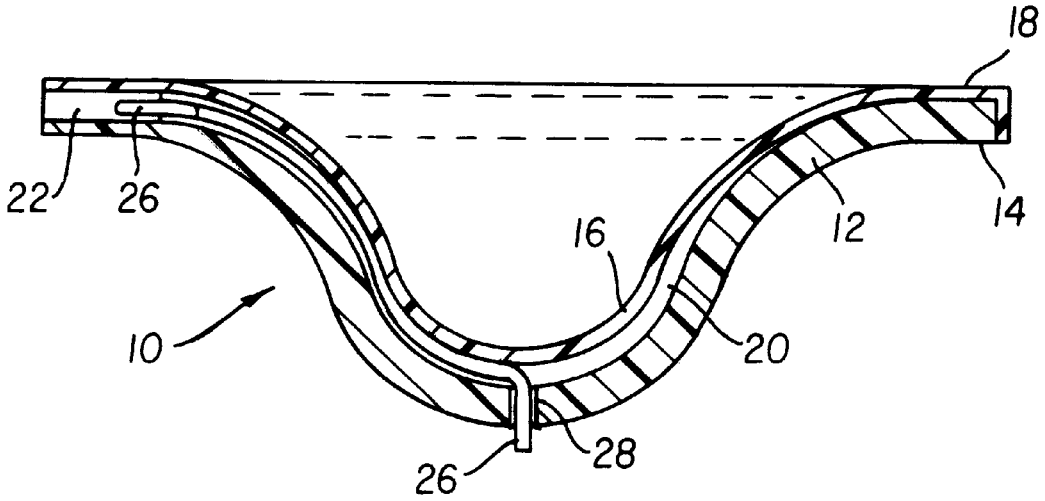
FIG. 3 is a sectional view taken substantially alone line 3—3 in FIG. 2.
Figure 4:
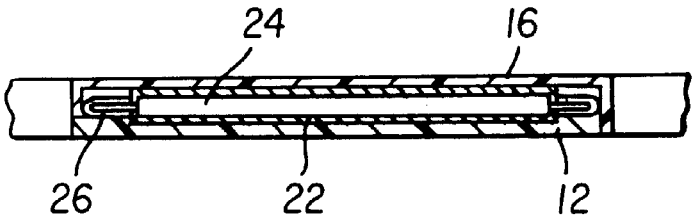
FIG. 4 is a sectional view taken substantially along line 4—4 in FIG. 2.

Referring to FIGS. 1–6, a combined planter and waterfall unit 10 in accordance with a first embodiment of the invention generally comprises a lower receptacle portion 12 having a rim 14, and an upper receptacle portion 16 having a size and shape complementary to that of the lower receptacle portion so that it can be mounted on the inside of the lower receptacle portion 12. The upper receptacle portion 16 has a rim 18 that rests on the lower receptacle rim 14 to position the upper receptacle portion 16 within the lower receptacle portion with a predetermined space 20 therebetween, as shown in FIG. 3.

Figure 6:
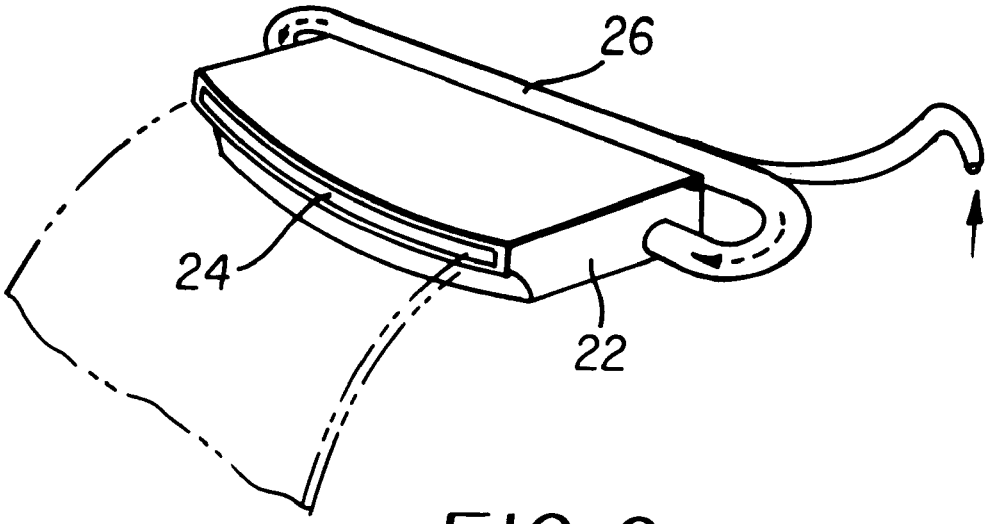
FIG. 6 is a perspective view of an embodiment of the water dispensing unit of the present invention.

A water dispensing unit 22 of any suitable construction is mounted on the lower receptacle portion 12 and is positioned between the upper and lower receptacle portions with the outer edge of its dispensing opening 24 being substantially flush with or in close proximity to the adjacent outer edges of the rims 14, 18 of the lower and upper receptacle portions. Preferably, the dispensing opening 24 of the water dispensing unit 22 is in the form of a wide opening or slit of narrow height defined by a sharp lower edge portion to produce a thin, wide and uniform flow or waterfall as illustrated in FIG. 6. In use, the combined planter and waterfall unit 10 is positioned near the edge of a pool or the like so that the waterfall produced thereby flows into the pool.

The water dispensing unit 22 is connected in any suitable manner to a water source (not shown), such as the pool water, by a water line 26 which extends therefrom through the space 20 between the upper and lower receptacle portions 16, 12, and then outwardly through an opening 28 in the lower receptacle portion, as shown in FIG. 3. The outer end of the water line is connected in any suitable manner to a water source such as the pump for circulating pool water or the like.

Figure 1:
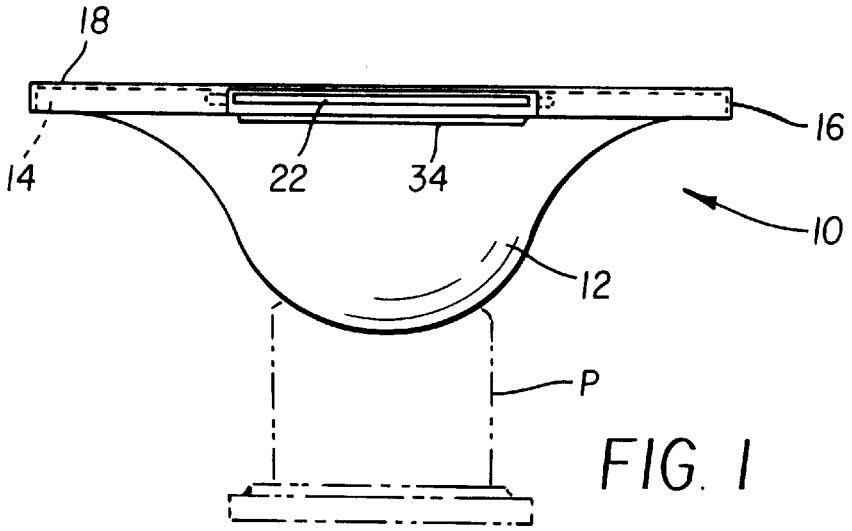
FIG. 1 is a side elevation view, with parts shown in broken lines, of a first embodiment of the present invention.
Figure 2:
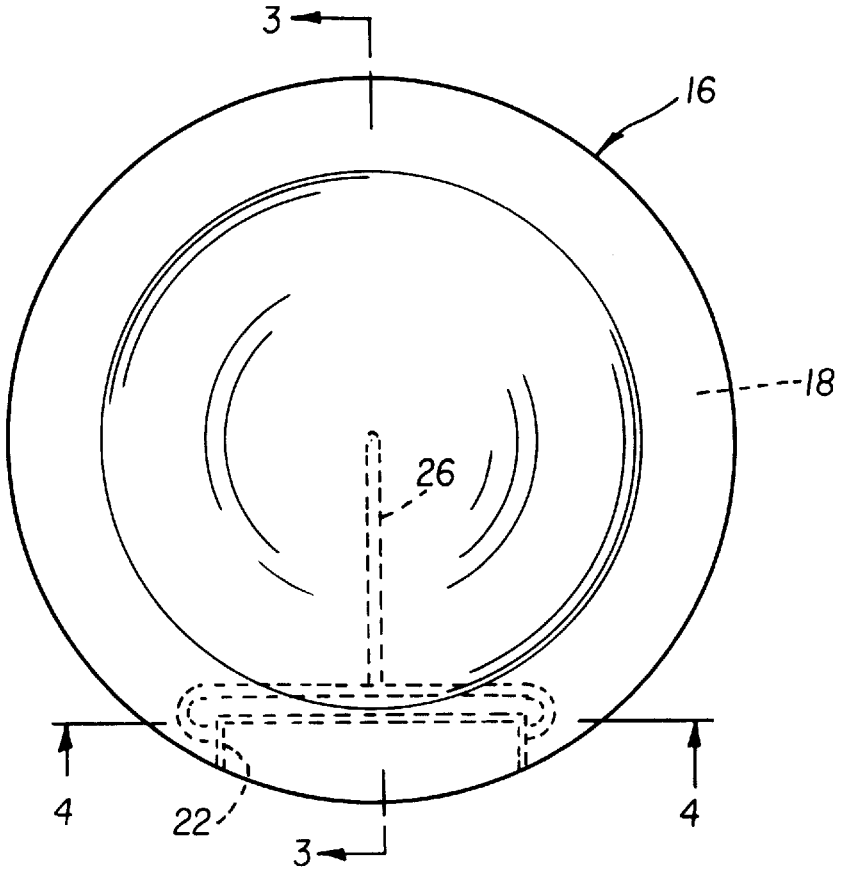
FIG. 2 is a top plan view of the present invention shown in FIG. 1, with parts shown in broken lines.

The upper and lower receptacle portions 16, 12 may be of any suitable shape and may be formed of any suitable material. The upper receptacle portion 16 preferably is of a shape that includes a bowl shaped depression that can be used as a planter by filling it with soil or the like and planting a desired plant or plants (not shown) therein. In this manner the combined planter and waterfall unit 10 serves a dual function in a very simple construction. As shown in FIG. 1, the unit may be mounted on a pedestal P or the like of any suitable construction.

Preferable, the rim 18 of the upper receptacle portion is recessed on the lower surface thereof so as to fit over the rim 14 of the lower receptacle portion 12. The upper receptacle portion 16 may merely rest on the lower receptacle portion 12 so as to be removable therefrom, or may be secured in any suitable manner, such as by an adhesive, to the lower receptacle portion.

Figure 5:
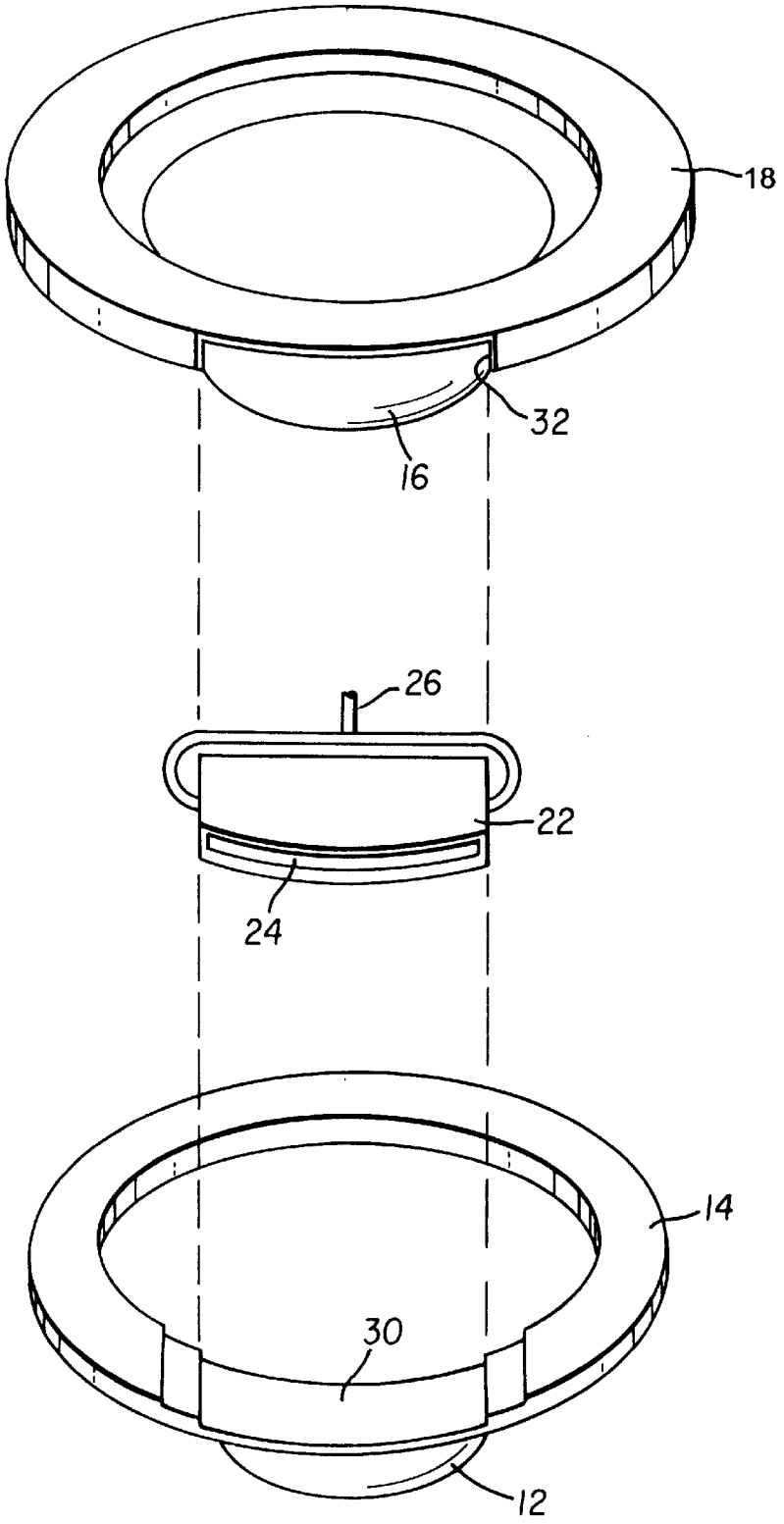
FIG. 5 is an exploded perspective view of the components of the present invention shown in FIG. 1.

As shown in FIG. 5 the rim 14 of the lower receptacle portion 12 may be provided with a recess 30 for receiving the water dispensing unit 22 therein, and the rim 18 of the upper receptacle portion 16, may be provided with an opening 32 to accommodate the water dispensing unit 22.

As an additional feature, lighting means such as a fiber optic stick 34 (FIG. 1) coupled to a light source (not shown) may be mounted on the lower portion of the rim 14 beneath the water dispensing unit 22 for the purpose of illuminating the waterfall flowing therefrom. The lighting means may be on any suitable form or construction.

Figure 9:
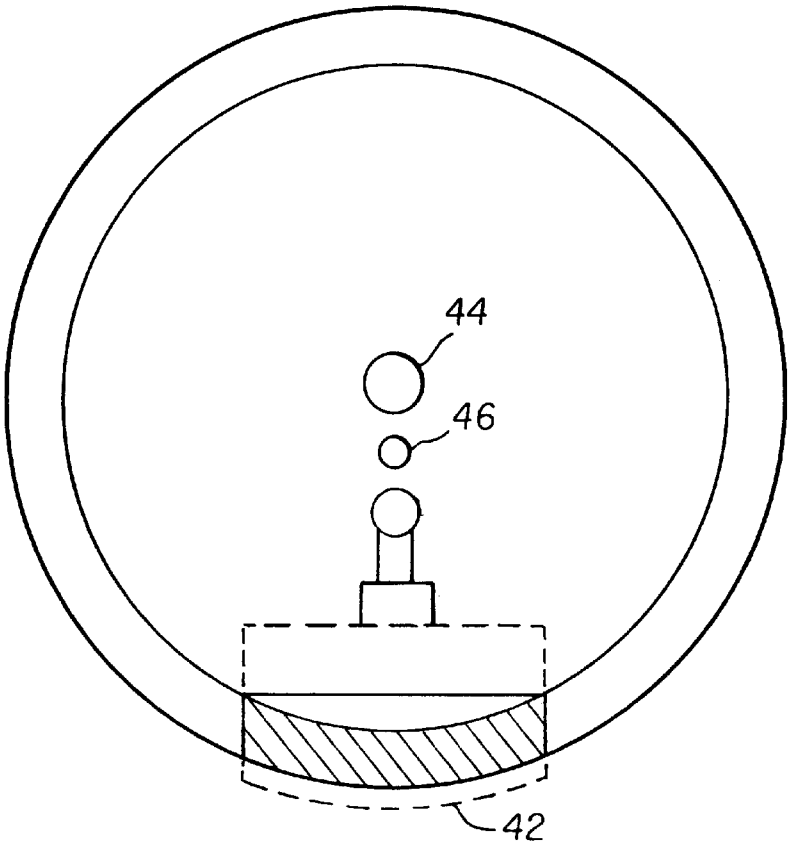
FIG. 9 is a plan view of the embodiment of the present invention shown in FIG. 7.
Figure 7:
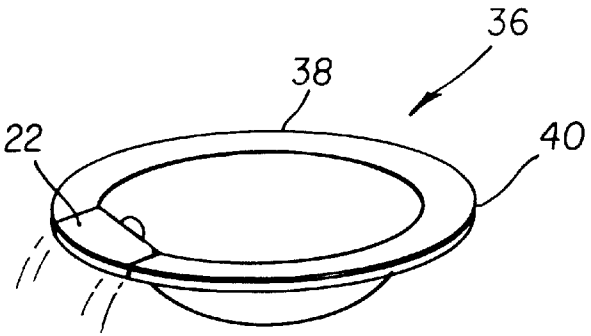
FIG. 7 is a top perspective view of a second embodiment of the present invention in use as a waterfall.
Figure 8:
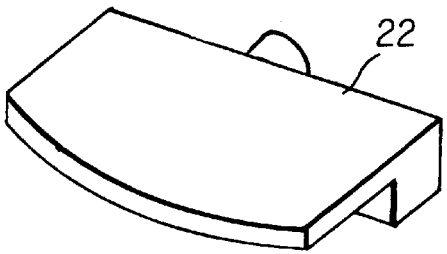
FIG. 8 is a perspective view of another embodiment of the water dispensing unit.
Figure 10:
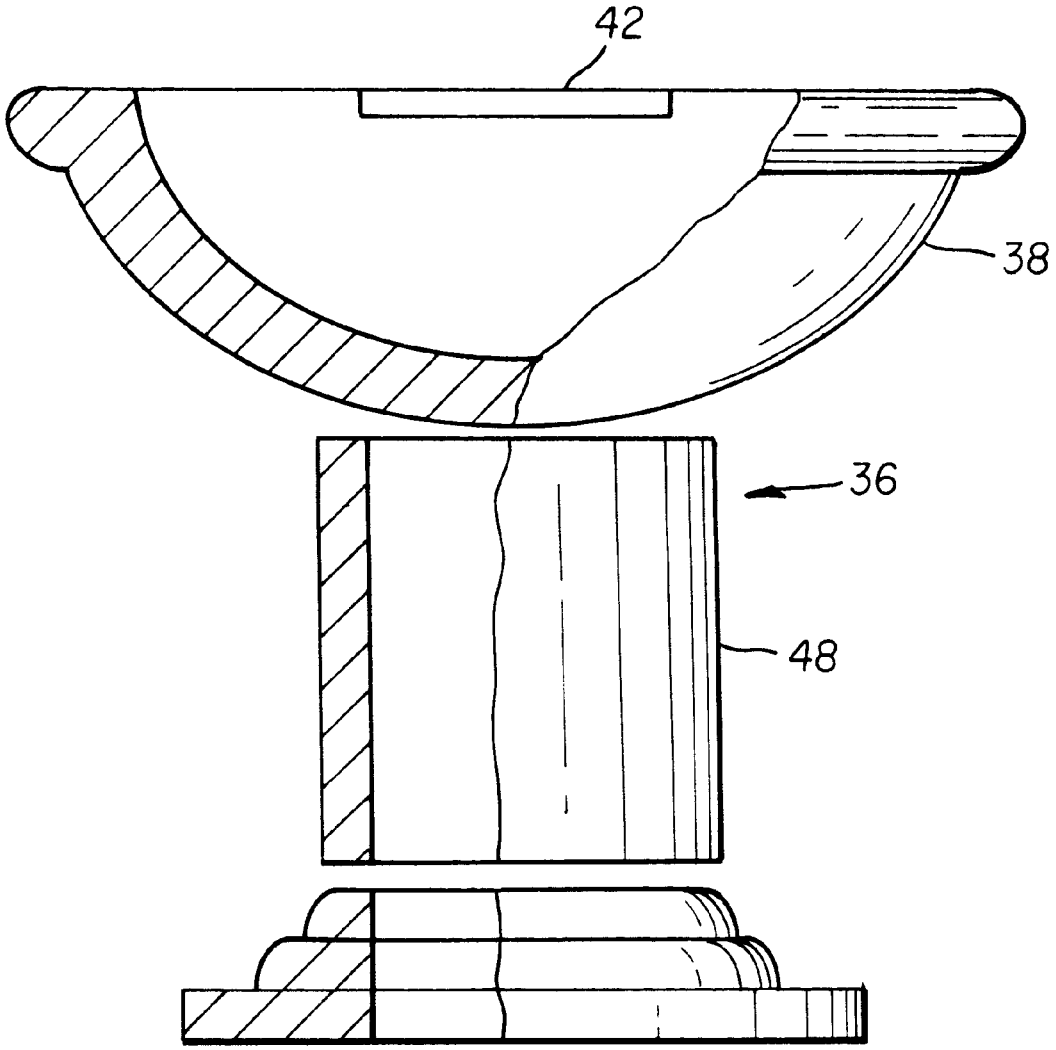
FIG. 10 is a sectional side view of the embodiment of the present invention shown in FIG. 7.

Alternatively, the upper and lower receptacle portions may be formed of unitary construction, in accordance with a second embodiment of the invention illustrated in FIGS. 7–9. As shown in FIG. 7, the combined planter and waterfall unit 36 comprises a solid one piece receptacle 38 having an upper rim 40 on which a the water dispensing unit 22 is mounted. The one piece receptacle unit 38 is preferably composed of a cement material formed in a mold, although other materials—including plastics or plasters—may be readily employed as well as other manufacturing processes. The rim 40, as illustrated in FIGS. 9 and 10, preferably includes a recess 42, which is sized to fit the water dispensing unit 22, so that the water dispensing unit 22 is mounted flush with the upper surface of the rim 40. Further, as shown in FIG. 9 and in accordance with a preferred embodiment of the present invention, a drain hole 44 and a water supply hole 46 extend through the bottom of the receptacle 38. The water supply line may be 26 run through the water supply hole 46 and connected in any suitable manner to the water dispensing unit 22. As in the case of the first embodiment, the receptacle 38 may be mounted on a pedestal 48 as shown in FIG. 10.

In contrast to the first embodiment, the water supply line 26 will be visible to an observer looking into the receptacle 38. The water supply line 26, however, is hidden from view when plants are placed in the receptacle 38. Accordingly, the second embodiment can provide the equivalent visual affect when utilized for its intended purpose, while being much easier and less expensive to manufacture.

The invention has been described with reference to certain preferred embodiments thereof. It will be understood, however, that modifications and variations are possible within the scope of the appended claims. For example the receptacle may be configured in any desired vessel type shape for example a square, a rectangular box, a triangular box, an oval box, a flower pot, etc.

What is claimed is:

1. A decorative accessory unit for a swimming pool or the like, comprising:

a receptacle having an interior surface;

an upper rim around a top portion of the receptacle;

a water dispensing device mounted to the upper rim; and a water supply line coupled to the water dispensing device, wherein the water supply device dispenses water substantially laterally away from the upper rim of the receptacle such that the water does not flow within or wet the interior surface of the receptacle; and the water supply line aid the water dispensing device segregate the water from the interior surface of the receptacle.

2. The unit of claim 1, wherein the rim includes a recess and the water dispensing device is mounted in the recess.

3. The unit of claim 1, wherein the water dispensing device includes a wide dispensing opening of narrow height that is defined by a lower sharp edge portion to dispense water in a thin, substantially uniform film.

4. The unit of claim 3, wherein a lighting means is mounted near the sharp edge portion of the water dispensing device to illuminate the film of water dispensed therefrom.

5. The unit of claim 4, wherein the lighting means comprises an elongated fiber optic means positioned beneath and extending along the sharp edge portion of the water dispensing means.

6. The unit of claim 1, wherein the receptacle includes a bowl shaped depression.

7. The unit of claim 1, wherein the receptacle has a water supply opening there through and the water dispensing device further comprises a water supply line that extends through the water supply opening.

8. The unit of claim 1, wherein the receptacle has a water drain opening there through.

* * * * *